United States Patent [19]

Rhoades

[11] Patent Number: 4,489,583

[45] Date of Patent: Dec. 25, 1984

[54] PORTABLE SHEET BENDING BRAKE

[75] Inventor: James J. Rhoades, Garden City, Mich.

[73] Assignee: Tapco Products Company, Inc., Detroit, Mich.

[21] Appl. No.: 359,566

[22] Filed: Mar. 18, 1982

[51] Int. Cl.[3] ..... B21D 5/04

[52] U.S. Cl. ..... 72/319; 269/236; 269/239; 269/284

[58] Field of Search ..... 72/319–323; 269/236, 239, 277, 284, 285, 257

[56] References Cited

U.S. PATENT DOCUMENTS

| | | | |
|---|---|---|---|
| 412,166 | 10/1889 | Dawson | 269/285 |
| 530,733 | 12/1894 | Tower | 269/285 |
| 2,217,378 | 10/1940 | Nilsby | 72/319 |
| 2,225,592 | 12/1940 | MacFadden | 29/453 |
| 2,322,291 | 6/1943 | Gearing | 269/285 |
| 2,387,102 | 10/1945 | Wallis | 269/285 |
| 2,602,358 | 7/1952 | Lile | 269/236 |
| 2,627,371 | 2/1953 | Kaufmann | 29/453 |
| 2,788,687 | 4/1957 | Ridge | 269/239 |
| 2,925,109 | 2/1960 | Walker | 269/285 |
| 3,129,938 | 4/1964 | Riley | 269/236 |
| 3,161,223 | 12/1964 | Marsh | 72/297 |
| 3,482,427 | 12/1969 | Barnack | 72/319 |
| 3,559,444 | 2/1971 | Blazey et al. | 72/296 |
| 3,817,075 | 6/1974 | Marsh et al. | 72/319 |
| 4,081,986 | 4/1978 | Break | 72/320 |
| 4,092,841 | 6/1978 | Chambers, Jr. | 72/320 |
| 4,237,716 | 12/1980 | Onisko | 72/319 |
| 4,240,279 | 12/1980 | Rhoades | 72/319 |
| 4,364,254 | 12/1982 | Chubb et al. | 72/319 |

*Primary Examiner*—Daniel C. Crane

*Attorney, Agent, or Firm*—Barnes, Kisselle, Raisch, Choate, Whittemore & Hulbert

[57] ABSTRACT

A sheet bending brake comprising a plurality of C-shaped frame members that support a first member. The first member has a clamping surface. A second member is hinged to the first member and has a bending surface. A plurality of bars are pivoted to the frame members and support an anvil member that extends longitudinally of the first member. A cam support shaft is rotatably mounted on the frame members and a plurality of eccentric cams are secured on the shaft. Each bar is generally C-shaped and a cam is positioned between the upper and lower flanges thereof. A handle is secured to the shaft such that when the handle is operated, the eccentric cams are rotated to move the bars and, in turn, the anvil member into and out of clamping position. A cover is provided on each bar to enclose the cam.

45 Claims, 10 Drawing Figures

PORTABLE SHEET BENDING BRAKE

This invention relates to sheet bending brakes and particularly to portable sheet bending brakes.

BACKGROUND AND SUMMARY OF THE INVENTION

In the handling of sheet material such as is used for building construction, it has been common in recent times to provide a portable sheet bending brake wherein sheet material is clamped between an anvil member and a clamping surface and a bending member is hinged for bending the sheet material about the anvil member. Typical sheet bending brakes are disclosed in U.S. Pat. Nos. 3,161,223, 3,481,174, 3,482,427, 3,559,444, 3,817,075 and 4,240,279.

As shown, for example, in the aforementioned U.S. Pat. Nos. 3,161,223, 3,559,444, 3,817,075 and 4,240,279, the anvil member is clamped into position by means of a backing plate that has inclined cams underlying a portion of the fixed frame so that when the plate is moved longitudinally by a hand lever, the cams are moved into and out of position clamping and unclamping the backing plate.

In the aforementioned U.S. Pat. Nos. 3,481,174 and 3,482,427, the anvil is supported by pivoted bars that, in turn, are connected by links to a handle that is pivoted on the frame of the brake so that rotation of the handle moves the bars and, in turn, the anvil into and out of clamping position.

It has also heretofore been suggested that eccentric cams be utilized for moving the anvil member into and out of position as shown, for example, in U.S. Pat. Nos. 3,383,899, 4,092,841 and 4,081,986.

Among the objectives of the present invention are to provide a portable sheet bending brake which is lighter in weight; which utilizes eccentric cams wherein the cams are not normally exposed but are accessible for easy adjustment, are easier to assemble and disassemble, and produce a positive and firm clamping of the anvil and, in turn, the sheet; wherein the sheet bending brake incorporates a novel stop for positioning the sheet to be bent; wherein the sheet bending brake incorporates frame members that have a novel construction; wherein the sheet bending brake incorporates novel extruded fixed and bending members; wherein the sheet bending brake involves a novel protective strip for the anvil member about which the sheet is bent.

DESCRIPTION

Figure 1:
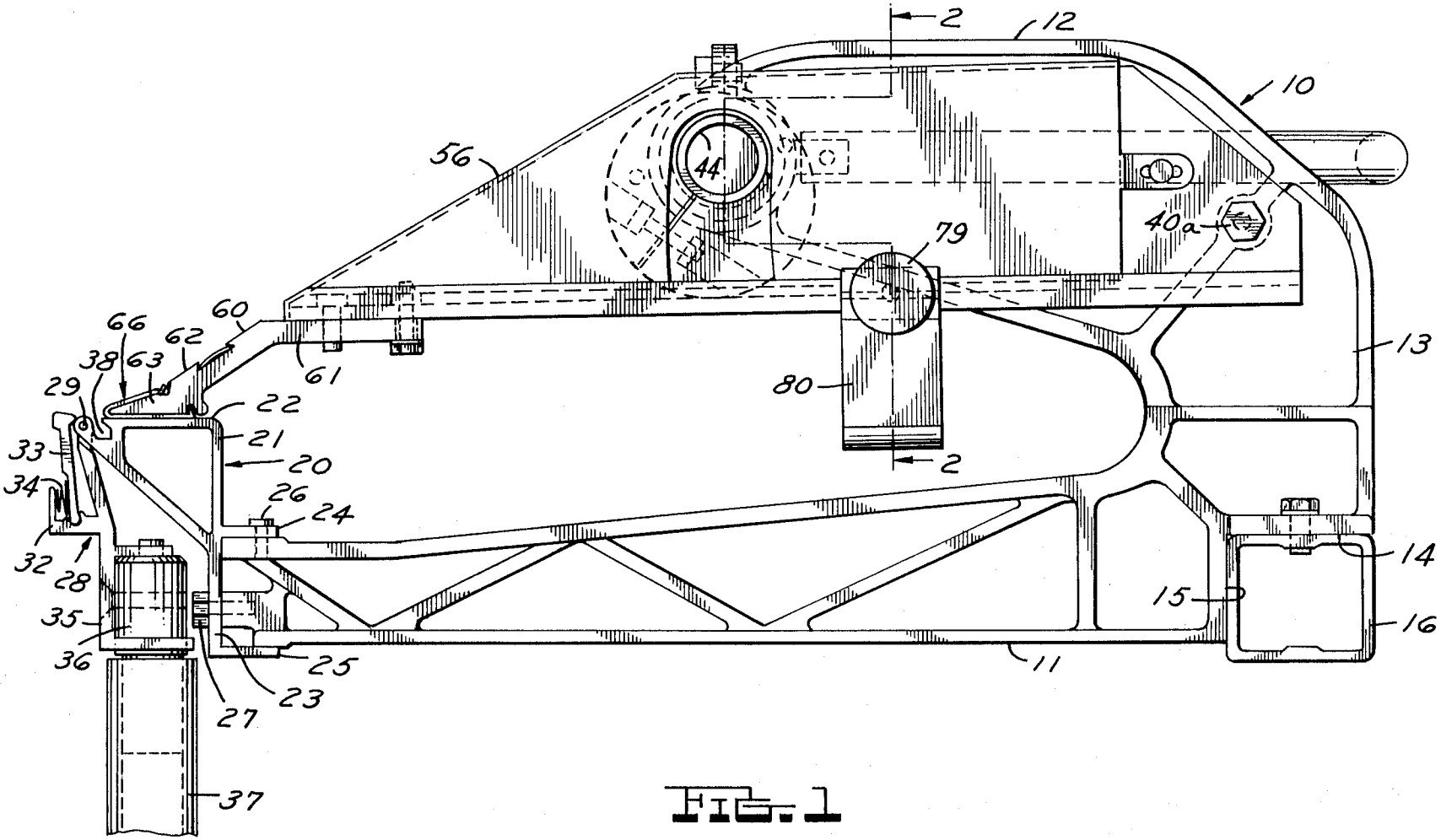
FIG. 1 is a fragmentary side elevational view of a sheet bending brake embodying the invention.
Figure 4:
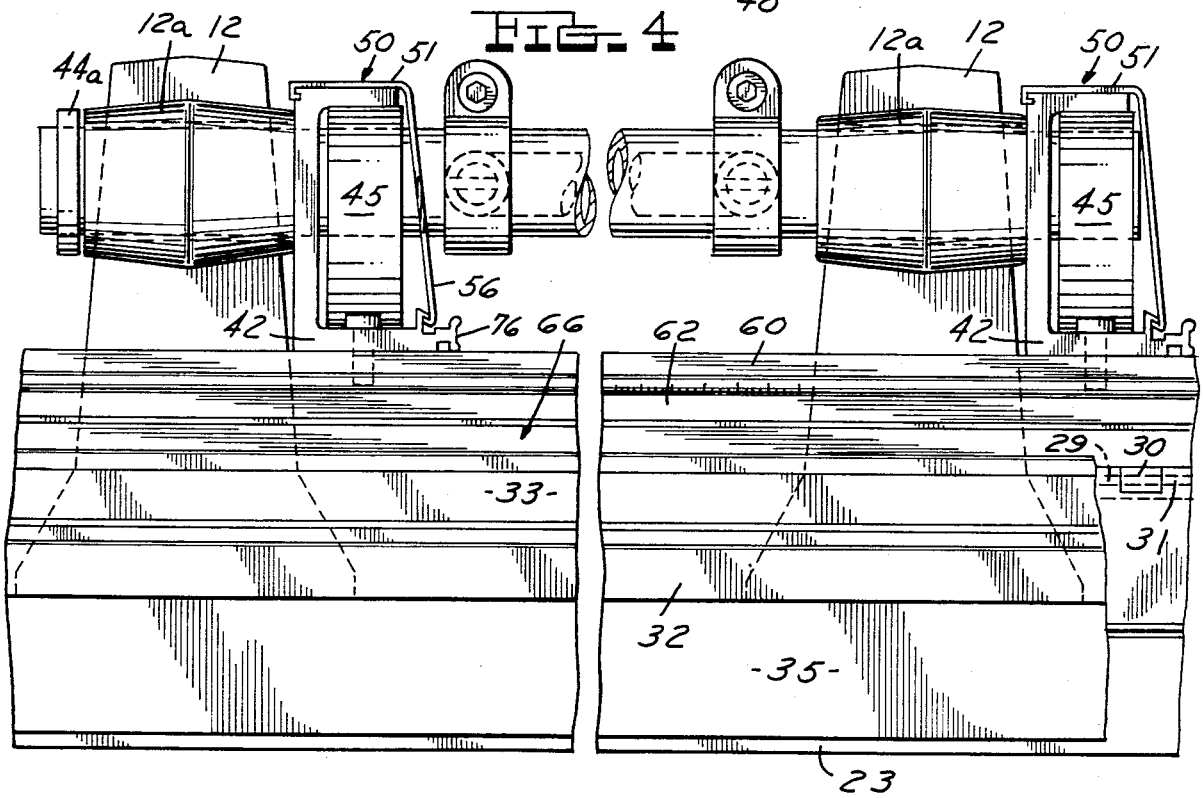
FIG. 4 is a fragmentary front elevational view of the sheet bending brake.
Figure 5:
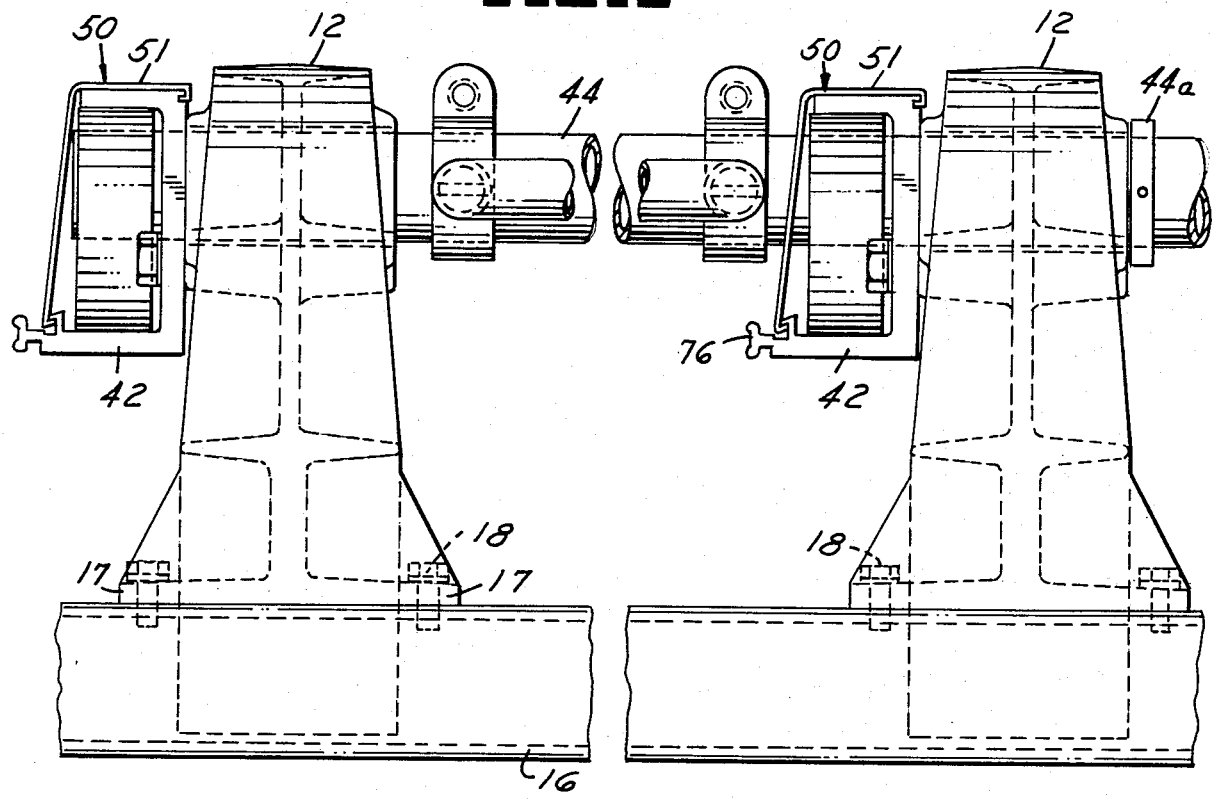
FIG. 5 is a fragmentary rear elevational view of the sheet bending brake.

Referring to FIGS. 1, 4 and 5, the sheet bending brake embodying the invention comprises a plurality of longitudinally spaced C-shaped frame members 10 which are preferably injection molded of reinforced plastic such as 30% glass filled nylon. Each frame member 10 includes a lower arm 11 and an upper arm 12 with a connecting portion 13, the upper arm 12 being shorter than the lower arm 11. Each frame member 10 includes a rearwardly extending recess or notch defined by a horizontal surface 14 and a vertical surface 15 for receiving an extruded aluminum square rear rail 16. As shown in FIG. 5, portion 13 includes laterally extending flanges 17 overlying the upper surface of the rear rail 16 through which screws 18 extend to fasten the rear rail to the frame members.

A first fixed extruded aluminum member 20 is provided on the front end of the lower arms 11 as presently described and comprises an upper generally triangular portion 21 defining a horizontal clamping surface 22 and a lower C-shaped portion 23 that has upper and lower walls 24, 25 that telescope over the free ends of the lower arms 11. Screws 26, 27 extend through openings in the upper wall 24 and vertical portion of the C-shaped portion 23 into the arm 11 to fasten the fixed member 20 on the arms 11.

An extruded aluminum bending member 28 is hinged to a portion of the fixed member 20 by a hinge defined by intermeshing projections 29, 30 on the member 28, 20, respectively. A hinge pin 31 extends through aligned openings in the projections 29, 30 to complete the hinge. The bending member 28 further includes a laterally extending L-shaped portion 32 that receives the lower end of an extruded floating member 33 yieldingly urged by a spring 34 against the hinge. The member 33 engages the sheet to be bent and minimizes marring during the bending as more fully described in U.S. Pat. Nos. 3,481,174 and 3,482,427 which are incorporated herein by reference. The fixed member 28 further includes a C-shaped portion 35 that supports an adapted 36 for receiving a tubular handle 37.

The fixed member 20 includes a downwardly open recess 38 for receiving the bent portions of a previously bent sheet to bend two portions of the sheet further toward one another.

The sheet bending brake further includes a plurality of extruded aluminum bars 40, a bar 40 being pivoted to each frame member 10 by a bolt **40*a* at the area of juncture of the rear of the arm 12 and the upper part of the connecting portion 13. Each bar 40 includes an upper flange 41, a lower flange 42, and a vertical wall 43. An aluminum shaft 44 is journalled in the forward ends of the upper arms 12 by plastic bearings 44*a* and extend through enlarged openings in the vertical walls of the bars 40. A plurality of plastic eccentric cams 45 are fixed on shaft 44 so that they are positioned between the upper and lower flanges 41, 42 of each bar. Each frame member 10 has axially extending bosses 12*a* surrounding the opening through which shaft 44 extends. A collar 44*a* holds shaft 44 axially against boss 12**.

Each cam 45 is split radially as at 46 and a bolt 47 and nut 48 clamps cam to the shaft 44. By loosening the bolt and nut, the position of the cam 45 can be adjusted on the shaft 44. Openings 48 are provided on the sides of cam 45 for receiving a spanner wrench to facilitate adjustment.

The open side of each bar 40 is closed to cover the cam by a protective plastic cover 50 that includes a top portion 51, a side wall portion 52, a hooked portion 53 extending along the vertical wall into a recess 54, and a hook at the lower portion of the wall 52 engaging a hook 56 integral with the flange 42. The cover further includes a front wall portion 56 that tapers downwardly and forwardly from the top portion 51 overlying the short upper flange 41 to the longer lower flange 42.

Figure 6:
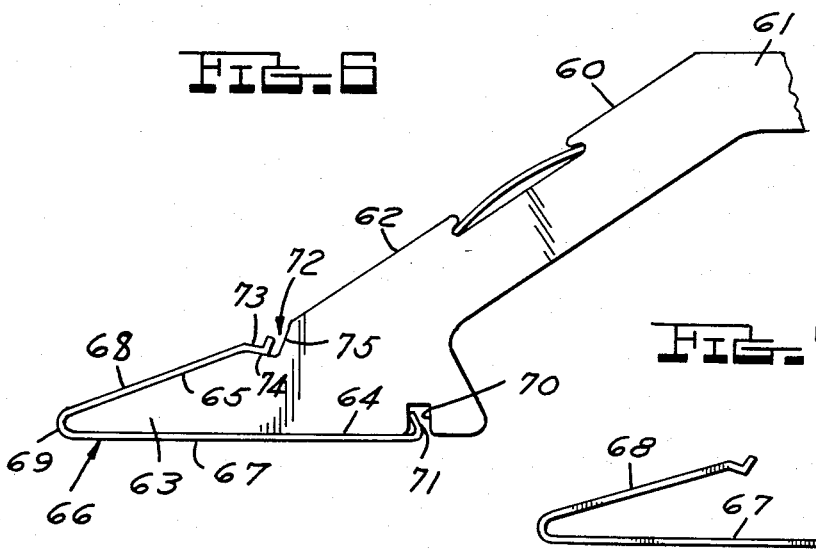
FIG. 6 is a fragmentary view of the anvil member.
Figure 7:
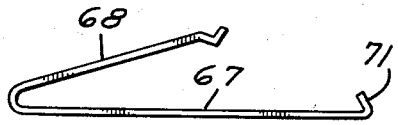
FIG. 7 is a side elevational view of the protective strip utilized on the anvil member.

The bars 40 support an anvil member 60 that includes an upper horizontal portion 61 bolted to the flange 42 of the bars, an inclined portion 62 and a V-shaped nose portion 63 having a horizontal bottom surface and an inclined upper surface. As shown in FIG. 6, a protective strip 66 of sheet metal such as rolled stainless steel is provided and includes a horizontal portion 67 extending along the surface 64, an inclined portion 68 extending along the surface 65 and a connecting sharply curved bending edge 69. The surface 64 of the anvil member includes a vertical slot 70 that receives a hook portion 71 forming an acute angle with the portion 67. The upper surface 65 includes an acute unsymmetrical slot 72 into which a hook portion 73 bent at 90° extends so that one leg is along the bottom surface 74 and the other leg has its free edge extending outwardly.

The sheet bending brake further includes an adjustable stop that is formed by a T-shaped extruded portion 76 defining a track on the lower flange of each bar that receives a complementary C-shaped portion 77 on a stop 78 so that the stop 78 can be moved along the track 76 and held in position by a thumb screw 79. The stop includes a downwardly extending portion 80 that is adapted to engage the rear edge of a sheet that is moved between the arms to provide a stop for adjusting the sheet in proper postion for bending.

A handle 81 is provided for rotating the shaft 44 to rotate cams 45 to move anvil member 60 into and out of clamping relation to surface 22. The handle 81 comprises a U-shaped tube including a central portion 82 and legs 83 that are telescoped over radial projections 84 on spaced collars 85 fixed on shaft 44 by screws 86. The collars 85 are split and adjustably clamped on shaft 44 so their position can be adjusted. The handle 81 is adjusted so that it extends horizontally when the anvil 60 is in clamping postion and is moved forwardly toward the operator and an upright position to move the anvil out of clamping position.

Figure 2:
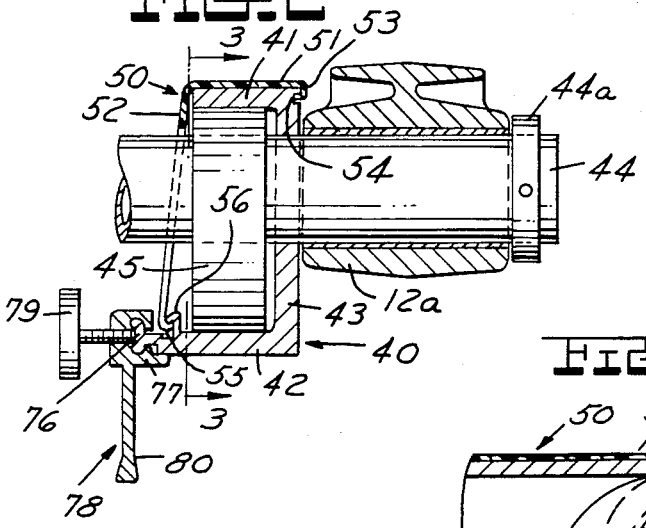
FIG. 2 is a fragmentary sectional view taken along the line 2—2 in FIG. 1.
Figure 3:
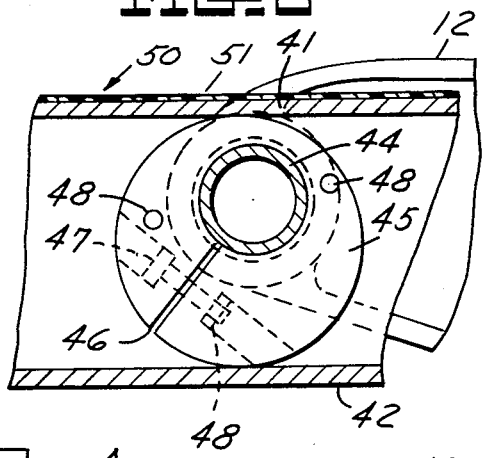
FIG. 3 is a fragmentary sectional view taken along the line 3—3 in FIG. 2.
Figure 8:
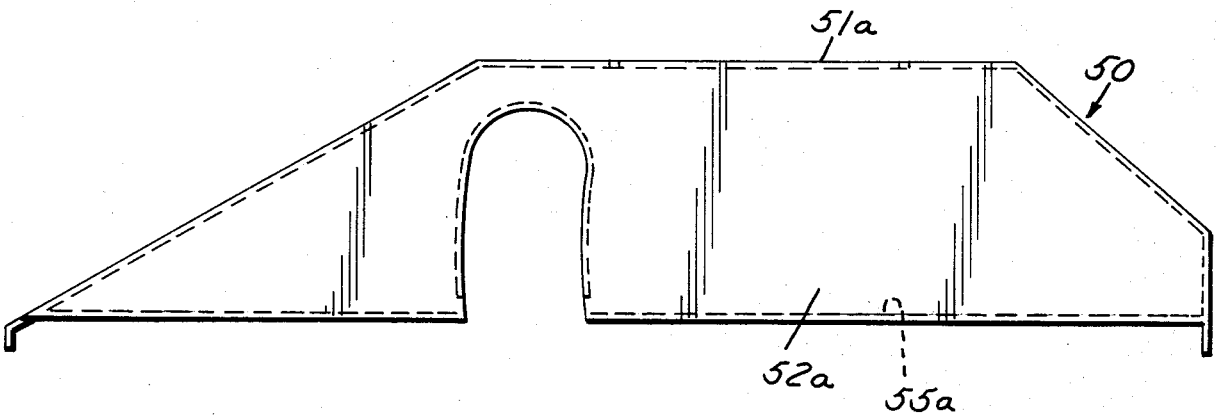
FIG. 8 is a side elevational view of a modified form of cover.
Figure 9:
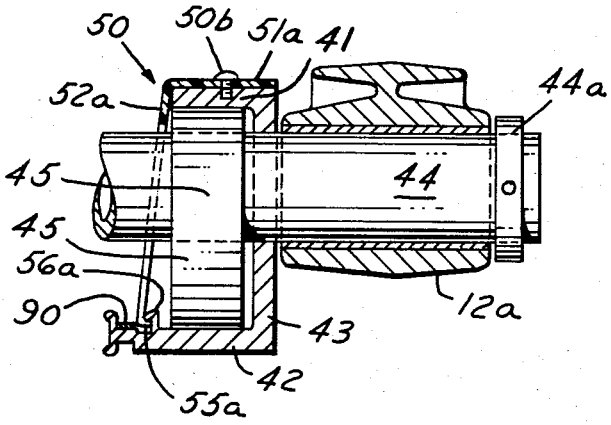
FIG. 9 is a sectional view similar to FIG. 2 of a sheet bending brake utilizing the cover shown in FIG. 8.
Figure 10:
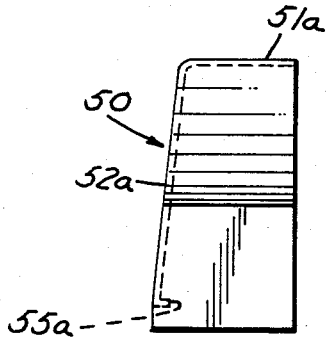
FIG. 10 is an end elevational view of the cover shown in FIG. 8.

In the form of the invention shown in FIGS. 8–10, a modified construction is shown wherein the cover **50*a* is modified to eliminate the hooked portion 53 (FIG. 2). In this form, the lower edge of the wall 52*a* has a hook 55*a* engaging a hook 56*a* on the flange. The top of the cover 50 is held in postion by screws 50*b* extending through the top portion 51*a* into the upper flange 41. A tape 90 having indicia thereon is provided along the track 76 for positioning stop 78**.

It can thus be seen that there has been provided a sheet bending brake which is lighter in weight, which utilizes eccentric cams that are not normally exposed but are easily accessible for adjustment; are easier to assemble and disassemble; which produces positive clamping of the sheet for bending; which incorporates a novel stop; and which incorporates novel frame members.

I claim:

1. A sheet bending brake adapted to be used by an operator facing the front of said brake comprising a plurality of generally C-shaped frame members, each said frame member including a long lower arm and a short upper arm overlying the lower arm, each frame member including a recess along the rear edge of the lower arm, a rear rail received in the recesses of said frame members and fastened thereto, a first member defining a clamping surface extending longitudinally, said first member having an integral C-shaped portion into which the forward end of the lower arms of the frame members extend, a bending member, means hinging said bending member to said first member, a plurality of bars with a bar individual to each said frame member and having its rear end pivoted to said frame member adjacent the rear of said upper arm and having its front end extending forwardly toward the operator, an anvil member extending longitudinally of said sheet bending brake and fixed to said bars, each said bar being generally C-shaped and including an upper horizontal flange, a lower horizontal flange and a vertical wall connecting said flanges, a shaft journalled in the forward ends of the upper arms of said C-shaped members and extending through the vertical walls of said bars, a cam fixed on said shaft individual to each said bar and positioned to cooperate with the upper and lower flanges such that rotation of said shaft pivots said bars and, in turn, said anvil member into and out of clamping position, and a cover enclosing the open side of said upper and lower flanges such that the cam is covered and normally unexposed.

2. The sheet bending brake set forth in claim 1 wherein each said bar includes longitudinally extending grooves into which portions of the cover extend for retaining the cover in position.

3. The sheet bending brake set forth in claim 2 wherein said grooves are positioned at the juncture of the upper flange and the vertical wall and at the free edge of the flange of the lower wall.

4. The sheet bending brake set forth in claim 1 wherein each said bar is extruded.

5. The sheet bending brake set forth in claim 1 wherein the forward end of each said bar nearest the operator is tapered upwardly and rearwardly such that the upper horizontal flange is shorter than the lower horizontal flange.

6. The sheet bending brake set forth in claim 1 wherein each said frame member is made of reinforced plastic material.

7. The sheet bending brake set forth in claim 1 wherein said cams are made of plastic, said shaft being made of metal such that there is a plastic to metal contact between relatively moving parts.

8. The sheet bending brake set forth in claim 1 wherein each said frame member has axially extending bosses in the area surrounding the shaft.

9. The sheet bending brake set forth in claim 1 wherein each said frame member includes laterally extending flanges overlying the rear rail.

10. The sheet bending brake set forth in claim 1 wherein each said cam member includes spaced openings adapted to receive a spanner wrench.

11. The sheet bending brake set forth in claim 1 wherein each said bar includes an integral portion along the lower flange defining a track, an adjustable stop having a complementary extruded portion engaging said track, and means for locking said stop in position along said track, said stop including a downwardly extending portion adapted to engage the free edge of a sheet inserted between the upper and lower arms to position the sheet for bending.

12. The sheet bending brake set forth in claim 1 wherein said fixed member on the forward ends of the lower arms of the frame members includes a generally triangular portion, the upper part of which defines the clamping surface.

13. The sheet bending brake set forth in claim 1 wherein said fixed member includes a longitudinally extending upwardly open-ended recess for receiving a portion of a sheet to be clamped.

14. The sheet bending brake set forth in claim 1 including a protective strip on said anvil member wherein said protective strip is made of uniformly thick material and rolled to form a lower leg adapted to extend along the anvil member, the anvil member having a longitudinally extending vertical slot therein, said protective strip having an upwardly extending portion forming an angle of less than 90° with the horizontal portion and extending upwardly into the slot, said protective strip having a second leg connected to the first leg to define a V-shaped portion, said anvil member having an upper tapered surface and a generally 90° shaped shoulder in the tapered surface, said second leg having a generally 90° bent free edge engaging the shoulder with the free terminal edge thereof engaging the vertical portion of the shoulder.

15. A sheet bending brake adapted to be used by an operator facing the front of said brakes comprising a plurality of generally C-shaped frame members, each said frame member including a long lower arm and a short upper arm overlying the lower arm, spaced rails connecting said frame members, a first member mounted on said lower arms defining a clamping surface extending longitudinally, a bending member, means hinging the bending member to said first member, a plurality of bars with a bar individual to each said frame member and having its rear end pivoted to said frame member and having its front end extending forwardly toward the operator, an anvil member extending longitudinally of said sheet bending brake and fixed to said bars, each said bar being generally C-shaped and including an upper horizontal flange, a lower horizontal flange and a vertical wall connecting said flanges, a shaft journalled in the forward ends of the upper arms of said C-shaped members and extending through openings in the vertical walls of said bars, a cam fixed on said shaft individual to each said bar and positioned to cooperate with the upper and lower flanges such that rotation of said shaft pivots said bars and, in turn, said anvil member into and out of clamping position, and a cover enclosing the open side of said upper and lower flanges such that the cam is covered and normally unexposed.

16. The sheet bending brake set forth in claim 15 wherein each said bar includes longitudinally extending grooves into which portions of the cover extend for retaining the cover in position.

17. The sheet bending brake set forth in claim 16 wherein each said bar is extruded.

18. The sheet bending brake set forth in claim 17 wherein the forward end of each said bar is tapered such that the upper flange is shorter than the lower flange.

19. The sheet bending brake set forth in claim 18 wherein said grooves are positioned at the juncture of the upper flange and the vertical wall and at the free edge of the flange of the lower wall.

20. The sheet bending brake set forth in claim 19 wherein each said frame member is made of reinforced plastic material.

21. The sheet bending brake set forth in claim 20 wherein said cams are made of plastic, said shaft being made of metal such that there is a plastic to metal contact between relatively moving parts.

22. The sheet bending brake set forth in claim 21 wherein each said frame member has axially extending bosses in the area surrounding the shaft.

23. The sheet bending brake set forth in claim 21 wherein each said cam member includes spaced openings adapted to receive a spanner wrench.

24. The sheet bending brake set forth in claim 15 wherein each said bar includes an integral portion along the lower flange defining a track, an adjustable stop having a complementary extruded portion engaging said track, and means for locking said stop in position along said track, said stop including a downwardly extending portion adapted to engage the free edge of a sheet inserted between the upper and lower arms to position the sheet for bending.

25. A sheet bending brake adapted to be used by an operator facing the front of said brake comprising a plurality of generally C-shaped frame members, each said frame member including a long lower arm and a short upper arm overlying the lower arm, each frame member including a recess along the rear edge of the lower arm, front and rear rails fastened to said frame members, a first member mounted on said lower arms and defining a clamping surface extending longitudinally, a bending member, means hinging said bending member to said first member, a plurality of extruded bars with an extruded bar individual to each said frame member and having its rear end pivoted to said frame member and having its front end extending forwardly toward the operator, an anvil member extending longitudinally of said sheet bending brake and fixed to said bars, each said bar being generally C-shaped and including an upper horizontal flange, a lower horizontal flange and a vertical wall connecting said flanges, a shaft journalled in the forward ends of the upper arms of said C-shaped members, a cam fixed on said shaft individual to each said bar and positioned to cooperate with the upper and lower flanges such that rotation of said shaft pivots said bars and, in turn, said anvil member into and out of clamping position, wherein each said bar includes an integral portion along the lower flange defining a track, an adjustable stop having a complementary extruded portion engaging said track, and means for locking said stop in position along said track, said stop including a downwardly extending portion adapted to engage the free edge of a sheet inserted between the upper and lower arms to position the sheet for bending.

26. The sheet bending brake set forth in claim 25 including a cover, each said bar including longitudinally extending grooves into which portions of the cover extend for retaining the cover in position.

27. A sheet bending brake adapted to be used by an operator facing the front of said brake comprising a plurality of generally C-shaped frame members, each said frame member including a long lower arm and a short upper arm overlying the lower arm, each frame member including a recess along the rear edge of the lower arm, a rear rail received in the recesses of said frame members and fastened thereto, a first member defining a clamping surface extending longitudinally, said first member having an integral C-shaped portion into which the forward end of the lower arms of the frame members extend, a bending member, means hinging said bending member to said first member, a plurality of bars with a bar individual to each said frame member and having its rear end pivoted to said frame member adjacent the rear of said upper arm and having its front end extending forwardly toward the operator, an anvil member extending longitudinally of said sheet bending brake and fixed to said bars, each said bar being generally C-shaped and including an upper horizontal flange, a lower horizontal flange and a vertical wall connecting said flanges, a shaft journalled in the forward ends of the upper arms of said C-shaped members and extending through the vertical walls of said bars, a cam fixed on said shaft individual to each said bar and positioned to cooperate with the upper and lower flanges such that rotation of said shaft pivots said bars and, in turn, said anvil member into and out of clamping position.

28. The sheet bending brake set forth in claim 27 wherein each said bar is extruded.

29. The sheet bending brake set forth in claim 27 wherein the forward end of each said bar nearest the operator is tapered upwardly and rearwardly such that the upper horizontal flange is shorter than the lower horizontal flange.

30. The sheet bending brake set forth in claim 27 wherein each said frame member is made of reinforced plastic material.

31. The sheet bending brake set forth in claim 27 wherein said cams are made of plastic, said shaft being made of metal such that there is a plastic to metal contact between relatively moving parts.

32. The sheet bending brake set forth in claim 27 wherein each said frame member has axially extending bosses in the area surrounding the shaft.

33. The sheet bending brake set forth in claim 27 wherein each said frame member includes laterally extending flanges overlying the rear rail.

34. The sheet bending brake set forth in claim 27 wherein each said cam member includes spaced openings adapted to receive a spanner wrench.

35. The sheet bending brake set forth in claim 27 wherein each said bar includes an integral portion along the lower flange defining a track, an adjustable stop having a complementary extruded portion engaging said track, and means for locking said stop in position along said track, said stop including a downwardly extending portion adapted to engage the free edge of a sheet inserted between the upper and lower arms to position the sheet for bending.

36. The sheet bending brake set forth in claim 27 wherein said fixed member on the forward ends of the lower arms of the frame members includes a generally triangular portion, the upper part of which defines the clamping surface.

37. The sheet bending brake set forth in claim 27 wherein said fixed member includes a longitudinally extending upwardly open-ended recess for receiving a portion of a sheet to be clamped.

38. The sheet bending brake set forth in claim 27 including a protective strip on said anvil member wherein said protective strip is made of uniformly thick material and rolled to form a lower leg adapted to extend along the anvil member, the anvil member having a longitudinally extending vertical slot therein, said protective strip having an upwardly extending portion forming an angle of less than 90° with the horizontal portion and extending upwardly into the slot, said protective strip having a second leg connected to the first leg to define a V-shaped portion, said anvil member having an upper tapered surface and a generally 90° shaped shoulder in the tapered surface, said second leg having a generally 90° bent free edge engaging the shoulder with the free terminal edge thereof engaging the vertical portion of the shoulder.

39. A sheet bending brake adapted to be used by an operator facing the front of said brake comprising a plurality of generally C-shaped frame members, each said frame member including a long lower arm and a short upper arm overlying the lower arm, spaced rails connecting said frame members, a first member mounted on said lower arms defining a clamping surface extending longitudinally, a bending member, means hinging the bending member to said first member, a plurality of bars with a bar individual to each said frame member and having its rear end pivoted to said frame member and having its front end extending forwardly toward the operator, an anvil member extending longitudinally of said sheet bending brake and fixed to said bars, each said bar being generally C-shaped and including an upper horizontal flange, a lower horizontal flange and a vertical wall connecting said flanges, a shaft journalled in the forward ends of the upper arms of said C-shaped members and extending through openings in the vertical walls of said bars, a cam fixed on said shaft individual to each said bar and positioned to cooperate with the upper and lower flanges such that rotation of said shaft pivots said bars and, in turn, said anvil member into and out of clamping position.

40. The sheet bending brake set forth in claim 39 wherein the forward end of each said bar is tapered such that the upper flange is shorter than the lower flange.

41. The sheet bending brake set forth in claim 39 wherein each said frame member is made of reinforced plastic material.

42. The sheet bending brake set forth in claim 39 wherein said cams are made of plastic, said shaft being made of metal such that there is a plastic to metal contact between relatively moving parts.

43. The sheet bending brake set forth in claim 42 wherein each said frame member has axially extending bosses in the area surrounding the shaft.

44. The sheet bending brake set forth in claim 42 wherein each said cam member includes spaced openings adapted to receive a spanner wrench.

45. The sheet bending brake set forth in claim 39 wherein each said bar includes an integral portion along the lower flange defining a track, an adjustable stop having a complementary extruded portion engaging said track, and means for locking said stop in position along said track, said stop including a downwardly extending portion adapted to engage the free edge of a sheet inserted between the upper and lower arms to position the sheet for bending.

* * * * *